US012044104B2

(12) United States Patent
Parameshwaraiah et al.

(10) Patent No.: US 12,044,104 B2
(45) Date of Patent: Jul. 23, 2024

(54) DIFFERENTIAL FILL VALVE WITH COLLET SLEEVE

(71) Applicant: Halliburton Energy Services, Inc., Houston, TX (US)

(72) Inventors: Rajesh Parameshwaraiah, Houston, TX (US); Lonnie Carl Helms, Houston, TX (US); Frank Vinicia Acosta Villarreal, Houston, TX (US); Maithri Muddasani, Houston, TX (US); Saul Emmanuel Vazquez Niebla, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 17/530,661

(22) Filed: Nov. 19, 2021

(65) Prior Publication Data

US 2023/0092656 A1 Mar. 23, 2023

Related U.S. Application Data

(60) Provisional application No. 63/245,627, filed on Sep. 17, 2021.

(51) Int. Cl.
*E21B 34/14* (2006.01)
*E21B 34/12* (2006.01)

(52) U.S. Cl.
CPC ..... *E21B 34/14* (2013.01); *E21B 34/12* (2013.01); *E21B 2200/04* (2020.05); *E21B 2200/05* (2020.05)

(58) Field of Classification Search
CPC ..... E21B 2200/04; E21B 2200/05; E21B 2200/06; E21B 34/14; E21B 34/142; E21B 34/12
See application file for complete search history.

(56) References Cited

U.S. PATENT DOCUMENTS 3,275,080 A 9/1966 Nelson et al.
4,474,241 A 10/1984 Freeman
4,729,432 A * 3/1988 Helms ..... E21B 34/14 166/317

(Continued)

FOREIGN PATENT DOCUMENTS

CN 110173233 A 8/2019
EP 2143875 A2 1/2010

(Continued)

OTHER PUBLICATIONS

International Search Report and Written Opinion dated Sep. 10, 2021, issued in PCT Application No. PCT/US2021/036587.

(Continued)

*Primary Examiner* — Christopher J Sebesta
(74) *Attorney, Agent, or Firm* — McAfee & Taft

(57) ABSTRACT

A valve housing has a first flapper moveable from an open position in the housing in which two-way flow is allowed to a closed position in which only one-way flow is permitted. A first collet sleeve is moveable from a first position to a second position in the valve housing. The first collet sleeve in the first position retains the flapper valve in the open position. The collet sleeve is moveable from a first position to a second position which allows the flapper to move to a closed position.

18 Claims, 8 Drawing Sheets

(56) References Cited

U.S. PATENT DOCUMENTS

| | | | | |
|---|---|---|---|---|
| 5,180,016 | A | 1/1993 | Ross et al. | |
| 5,230,390 | A | 7/1993 | Zastresek et al. | |
| 6,394,187 | B1 * | 5/2002 | Dickson | E21B 34/063 166/383 |
| 8,955,543 | B2 | 2/2015 | Groesbeck et al. | |
| 9,482,073 | B2 | 11/2016 | Andrigo | |
| 2002/0033262 | A1 | 3/2002 | Musselwhite et al. | |
| 2004/0163820 | A1 | 8/2004 | Bishop et al. | |
| 2011/0100647 | A1 * | 5/2011 | King | E21B 34/14 166/386 |
| 2011/0290344 | A1 * | 12/2011 | Groesbeck | E21B 34/16 137/430 |
| 2015/0136404 | A1 | 5/2015 | Groesbeck et al. | |
| 2015/0377372 | A1 * | 12/2015 | Andrigo | E21B 34/102 137/15.19 |
| 2017/0356270 | A1 | 12/2017 | Stair | |
| 2017/0370186 | A1 | 12/2017 | Stair | |
| 2018/0238460 | A1 | 8/2018 | Maricas | |

FOREIGN PATENT DOCUMENTS

| | | | |
|---|---|---|---|
| WO | 0169037 | A1 | 9/2001 |
| WO | 2016133539 | A1 | 8/2016 |
| WO | 2016133541 | A1 | 8/2016 |

OTHER PUBLICATIONS

International Search Report and Written Opinion dated Oct. 28, 2021, issued in PCT Application No. PCT/US2021/036771.
International Search and Written Opinion issued in corresponding PCT Application No. PCT/US2022/030659 dated Sep. 7, 2022.

* cited by examiner

DIFFERENTIAL FILL VALVE WITH COLLET SLEEVE

CROSS-REFERENCE TO RELATED APPLICATION

This application claims the benefit of U.S. Provisional Application No. 63/245,627 filed Sep. 17, 2021, which is incorporated herein by reference.

BACKGROUND

In the oil and gas industry, wellbores are drilled into the surface of the earth to access reservoirs for the extraction of hydrocarbons. Wellbores are often lined with casing or a string of casing sections or lengths, and the casing is then secured into place using cement. In one cementing technique, a cement composition is pumped through the interior of the casing and allowed to flow back toward the surface via the annulus defined between the wellbore wall and the casing. Once the cement composition cures within the annulus to form a hardened mass, the casing serves to stabilize the walls of the surrounding subterranean formation to prevent any potential caving into the wellbore.

When casing is being run into a wellbore it is sometimes desirable to "float" the casing down to its intended location within the wellbore fluid prior to the time the casing is cemented in the well. It is also desirable to have the casing fill automatically at a predetermined rate.

Float valves are one-way valves (i.e., check valves) that can be installed at or near the interior bottom end of a casing string. Once operational, float valves permit fluid (such as mud or cement) to flow down through the inside of the casing, but prevent fluids from flowing in the reverse direction back up the inside of the casing. By doing so float valves prevent cement that is pumped down through the casing and into the annular space from flowing back up through the valves once the cement is in place.

Float shoes and float collars permit automatic filling of the casing and incorporate a backpressure valve to prevent cement back flow into the casing after the cementing operation. Certain backpressure valves also permit the option of terminating the filling of the casing at any point in time. During the insertion of casing into the wellbore, a traditional auto-fill, flapper-type float valve is held open by a pin set across a sleeve in the valve assembly bore. When it is desired to actuate the backpressure valve to prevent further filling of the casing a weighted tripping ball is dropped, or carried in with the float valve, which breaks the pin holding the sleeve and thereby freeing the flapper valve to close. After cementing has been completed, the released flapper valve prevents cement flow back into the casing from the wellbore annulus. Due to the close operating pressures of the float valve, premature release of the flapper valve can occur. Additionally, the same operating conditions can cause the flapper valve to not release entirely.

DESCRIPTION OF THE DRAWINGS

FIG. 6 is a cross-sectional view of a fill valve assembly with first and second flapper valves in a closed position after a tripping ball has passed therethrough.

DESCRIPTION OF AN EMBODIMENT

Figure 1:
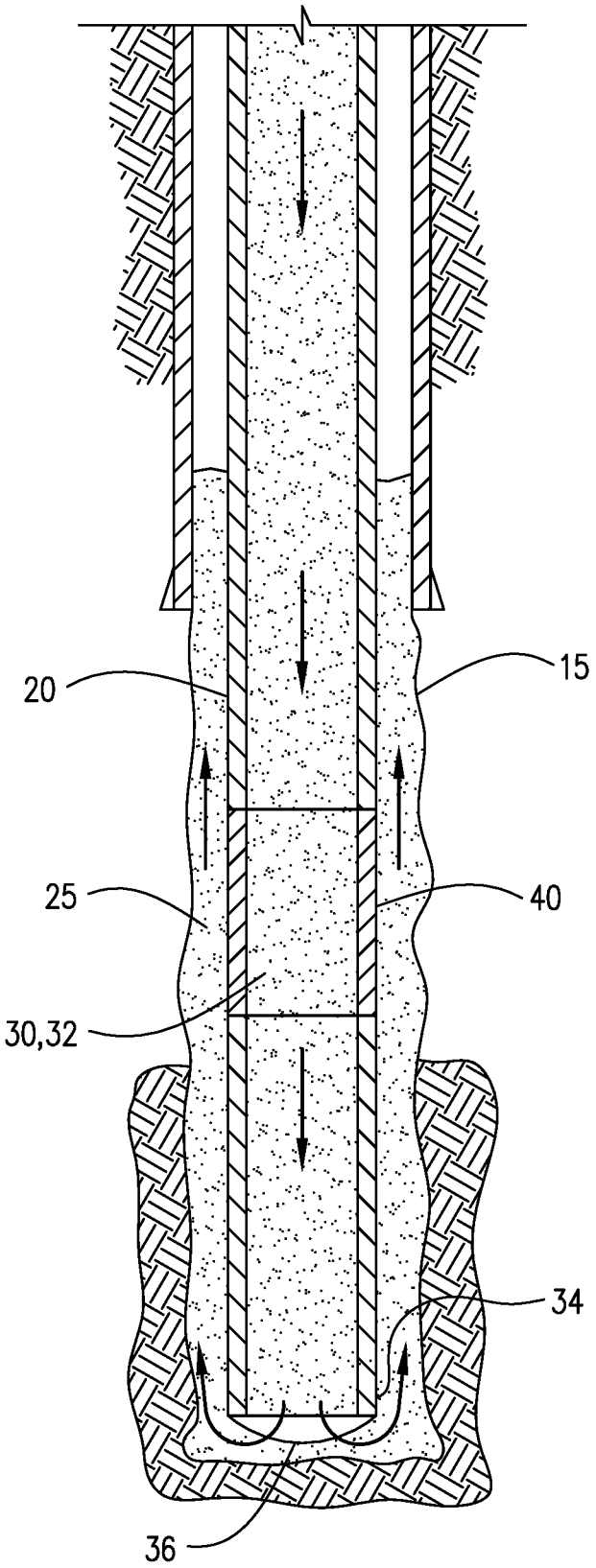
FIG. 1 illustrates a schematic cross-sectional side view of a casing with the fill valve assembly disclosed therein.

Referring now to the figures a wellbore 15 is shown with a casing string 20 lowered therein. Casing string 20 and wellbore 15 define an annulus 25 therebetween. Casing string 20 will be lowered from a wellhead installation at the surface of the earth in a manner known in the art. A casing shoe 36 may be attached at or near the end of casing string 20. To secure the casing string 20 within wellbore 15 cement 30 is pumped therethrough until it passes out the bottom end 34 of casing string 20. A casing shoe 36 may be attached to bottom end 34. Cement will flow out of bottom end 34 through casing shoe 36 and will travel upwardly in annulus 25.

A fill valve assembly 50 may be provided within a float collar 40 of casing string 20. Float collar 40 may be connected at its upper end 46 to upper casing 42 and at its lower end 48 to lower casing 44. Fill valve assembly 50 is fixed in float collar 40 with a cementitious body 41. The fill valve assembly 50 is held firmly in place by the cementitious body 41. As is apparent from the drawings, fluid, for example cement 30 will be directed through fill valve assembly 50 as there is no path around fill valve assembly 50 through float collar 40.

Fill valve 50 has outer housing 52, and has upper end 54 and lower end 56 and a central flow passage 57 therethrough. Fill valve 50 comprises a first flapper valve 58 and a second flapper valve 60 connected thereto. A ball cage 64 is connected to the upper end 54 of the housing 52, which is the upper end of the fill valve assembly 50. Cage 64 comprises a retaining ring 66 and a crows nest 68. A tripping ball 70 is initially trapped between retaining ring 66 and crows nest 68. Retaining ring 66 defines a diameter 74 that is smaller than diameter 72 of tripping ball 70. Tripping ball 70 may comprise a phenolic tripping ball or other material such that upon the application of pressure tripping ball 70 will deform slightly and pass through the diameter 74 of retainer 66. Crows nest 68 has a space 78 between the feet 76 thereof that will not allow tripping ball 70 to pass upwardly therethrough.

Figure 5:
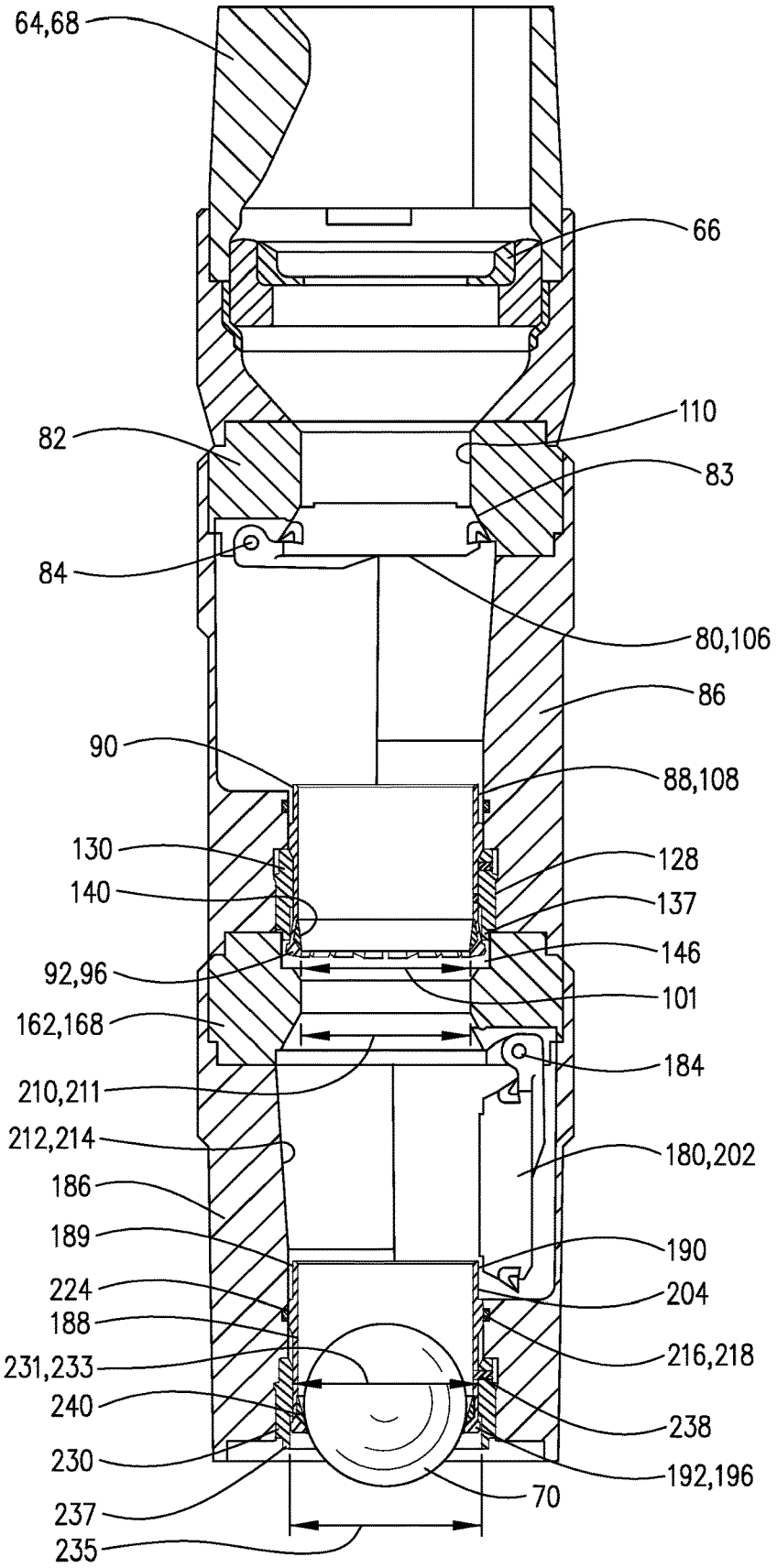
FIG. 5 is a cross-sectional view of a fill valve assembly with a first flapper in a closed position and the tripping ball engaging a second collet sleeve.
Figure 5:
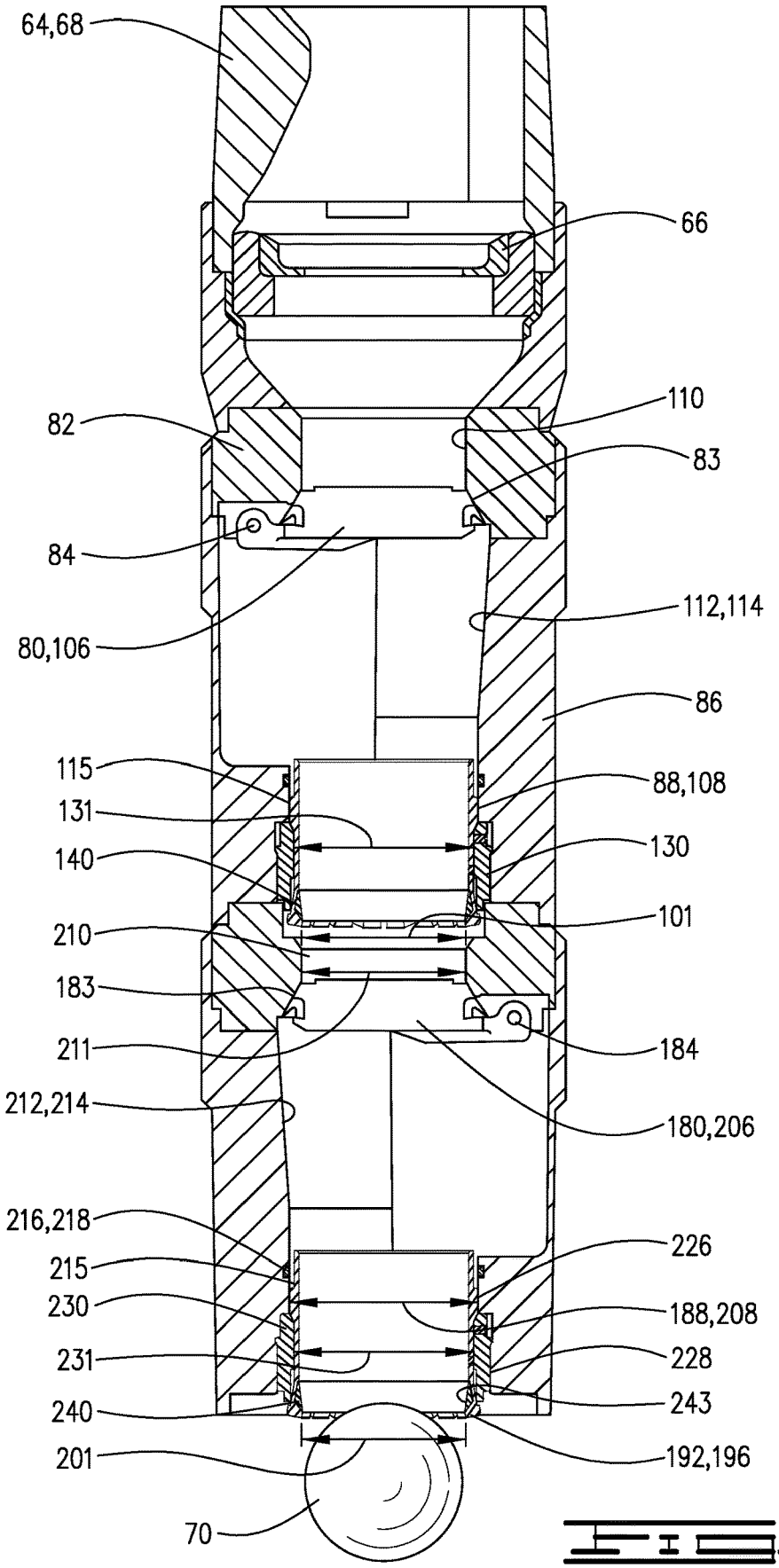

First flapper valve 58 comprises first flapper valve housing 62 which forms a part of outer housing 52. First flapper valve housing 62 comprises an upper housing portion 82 and a lower housing portion 86. A first flapper 80 is pivotally connected to upper housing portion 82 with a pivot pin 84 or other mechanism. First flapper 80 is biased with a spring or otherwise to move from the open position 102 to the closed position 106 which is shown in FIG. 5.

A lower housing portion 86 of first flapper valve 58 is connected to upper housing portion 82. First flapper 80 in the open position extends downwardly into lower housing portion 86 and is restrained in the open position by a first collet sleeve 88. First collet sleeve 88 is detachably connected in housing 52 and more specifically in lower housing portion 86 of first flapper valve housing 62. First collet sleeve 88 has outer surface 89, upper end 90 and lower end 92. First collet sleeve 88 has a plurality of first collet fingers 94 with radially inward facing first collet heads 96 at the lower end 92 of first collet sleeve 88. First collet heads 96 define a breakaway seat 98 which may be referred to as a first breakaway seat 98. First breakaway seat 98 has a diameter 100 which is smaller than diameter 72 of tripping ball 70. First breakaway seat 98 is expandable radially outwardly to a second diameter 101 which allows tripping ball 70 to pass therethrough. First breakaway seat 98 expands upon the application of a force thereto applied as a result of pressure being increased above tripping ball 70. The force required to deform the first breakaway seat 98 may be referred to as a first breakaway force. Collet fingers 94 have slots 93 therebetween. Spaces 93 extend from the lower end 92 of first collet sleeve 88 upwardly a distance 95, which in the embodiment described is a portion of the overall length from lower end 92 to upper end 90.

Figure 2:
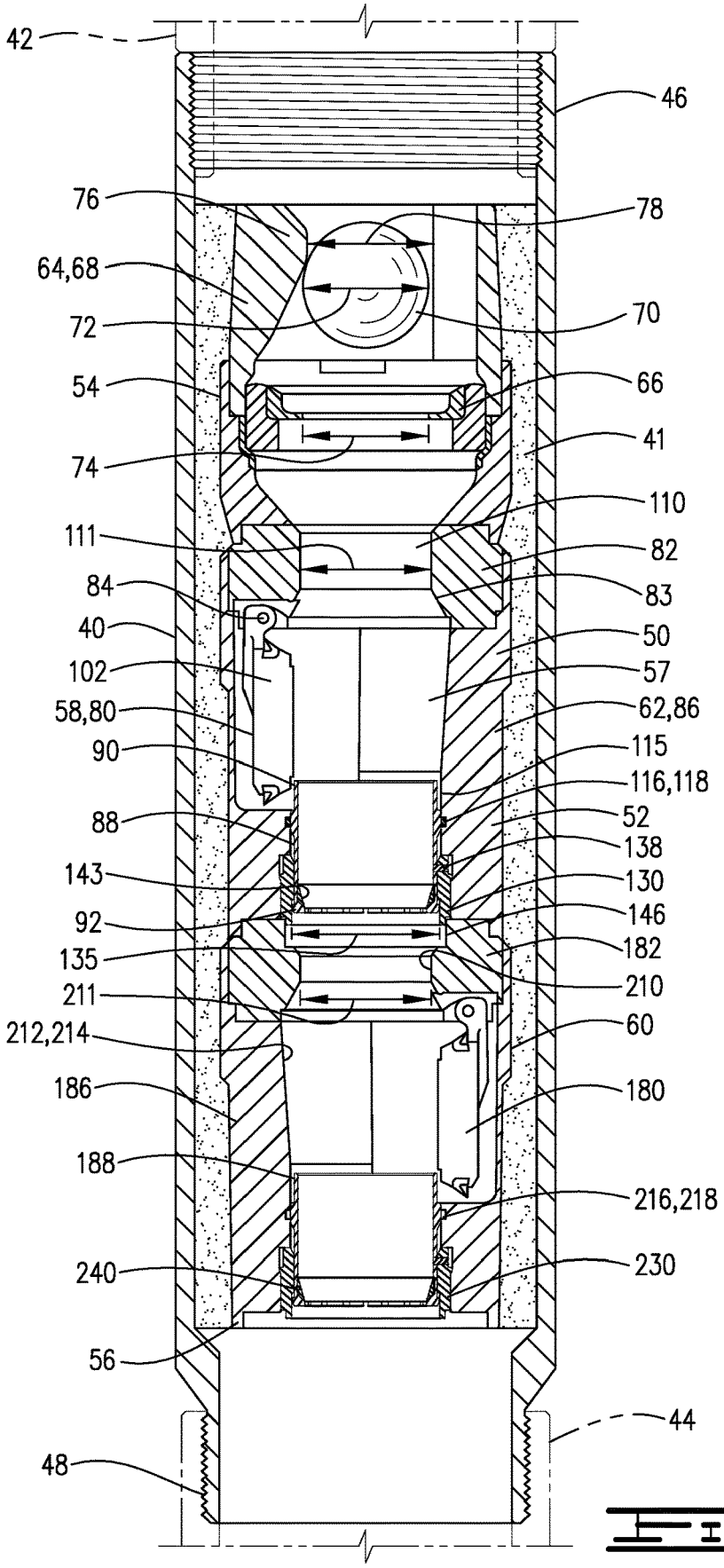
FIG. 2 is a cross-sectional view of a fill valve assembly of the current disclosure employed in a casing float collar.
Figure 3:
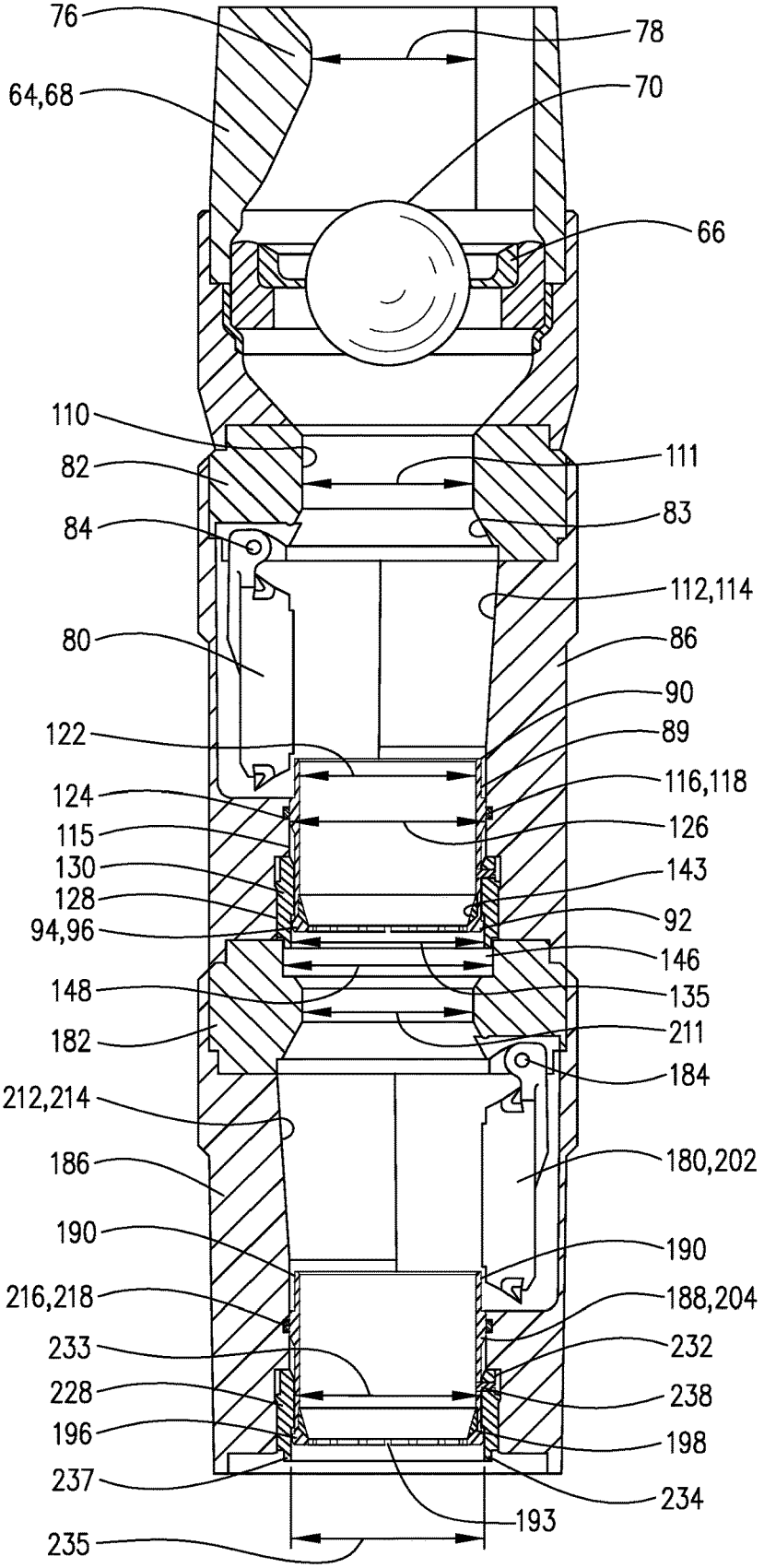
FIG. 3 is a cross-sectional view of a fill valve assembly in an open position with a tripping ball engaged with a retaining ring.
Figure 4:
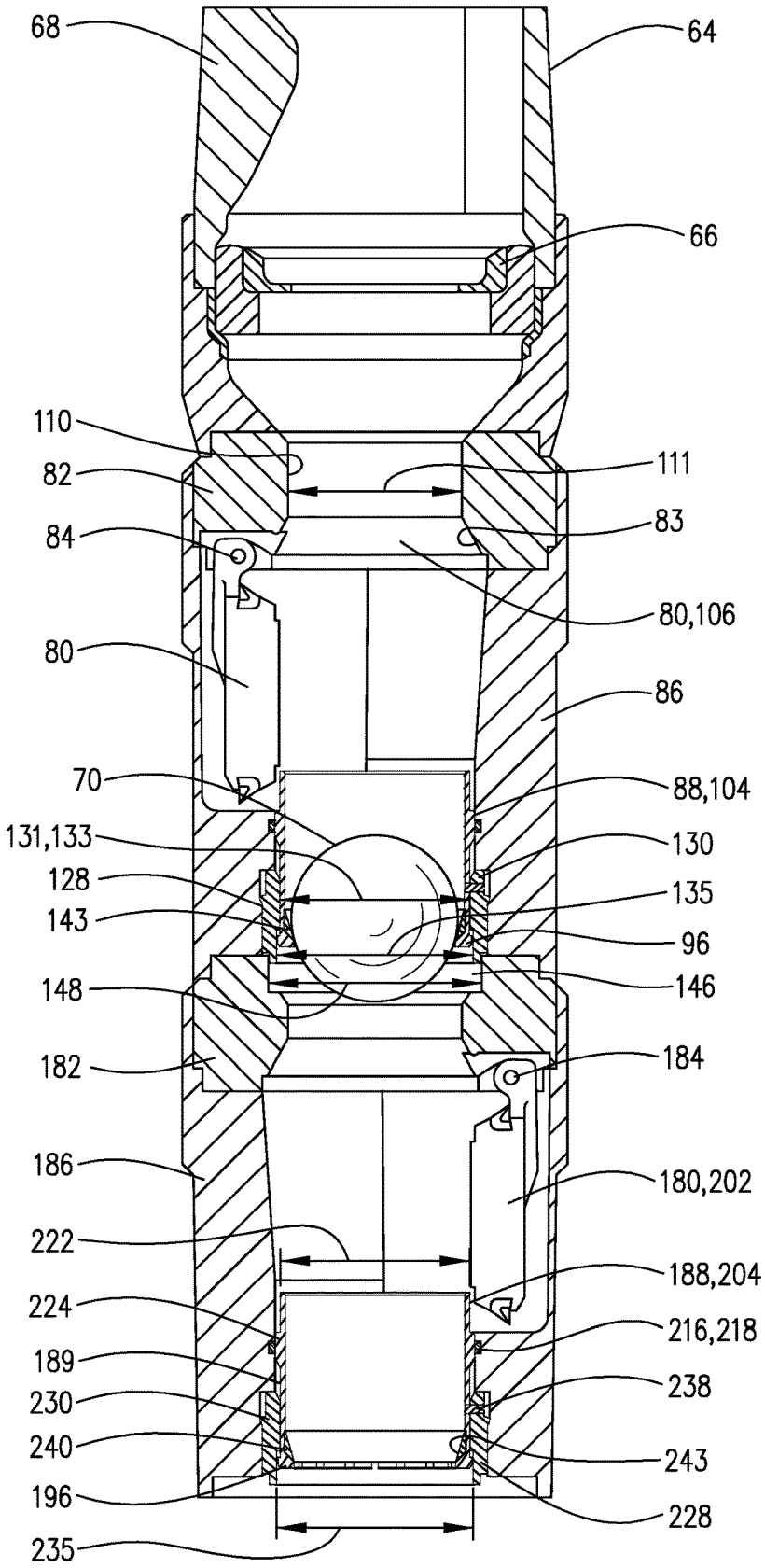
FIG. 4 is a cross-sectional view of a fill valve assembly with a tripping ball engaging a collet sleeve.

FIGS. 2-4 show the first position 104 of first collet sleeve 88 in which first collet sleeve 88 restrains first flapper 80 in its open position 102. In the open position 102 two-way flow is permitted through the first flapper valve housing 62. Thus, fluid will flow through flapper valve 58 as casing 20 is lowered into the wellbore 15 to the desired location. The closed position 106 of first flapper 80 is shown in FIGS. 5 and 6. In the closed position 106 one-way flow only is allowed through first flapper valve 58. Thus, cement can flow downwardly therethrough but upward flow is prevented by first flapper valve 58 and specifically by first flapper 80 which is biased towards upper housing 82 in which the closed position 106 will engage a seat 83 defined on upper housing portion 82 to prevent upward flow therethrough. First flapper 80 moves to the closed position 106 when first collet sleeve 88 is detached from first flapper valve housing 62 and moves downwardly to its second position 108.

Upper housing portion 82 has a bore 110 with a diameter 111 that is large enough to allow tripping ball 70 to pass therethrough. Housing 52 has a bore 112 and specifically lower housing portion 86 of first flapper valve housing 62 has a bore 112 that extends radially outwardly from bore 110. Bore 112 has a first portion 114 and a second portion 115 below first portion 114. Second portion 115 is a generally cylindrical portion. Second portion 115 has at least one groove 116 therein.

A seal, which may be an O-ring seal 118 is disposed in groove 116. O-ring seal 118 sealingly engages first collet sleeve 88 on outer surface 89 thereof. Outer surface 89 of first collet sleeve 88 has a first outer diameter 122 with an outwardly extending shoulder 124 extending radially outward therefrom. Shoulder 124 defines a second outer diameter 126 that is greater than outer diameter 122. O-ring seal 118 in one embodiment engages first collet sleeve 88 at the outer diameter 126 on shoulder 124.

A first annular space 128 is defined by and between the lower portion 86 of first flapper valve housing 62 and first collet sleeve 88. Annular space 128 is positioned below shoulder 124. A first installation sleeve 130 with upper end 132 and lower end 134 is positioned in annular space 128 and is threadedly connected to first flapper valve housing 62 on the lower housing portion 86 thereof. First installation sleeve 130 has inner surface 131 that defines a first inner diameter 133 and a second inner diameter 135 that is larger than diameter 133. Second diameter 135 is defined on a tail portion 137 of first installation sleeve 130. Collet heads 96 are initially held in place by first installation sleeve 130, and more specifically by tail portion 137 to prevent the breakaway seat 98 from expanding radial outwardly prematurely. Thus, first installation sleeve 130 retains collet heads 96 in the first position of first collet sleeve 88. A shear pin 138 detachably connects first collet sleeve 88 to first installation sleeve 130. First shear pin 138 in one embodiment is configured to shear at a predetermined force. The predetermined force generally will occur when a predetermined pressure is reached in the casing string as a result of a tripping ball 70 engaging collet heads 96 on first collet sleeve 88. O-ring seal 118 acts as a debris barrier and prevents debris from entering the space below shoulder 124 and into annular space 128.

A first seal bushing 140 which may be an elastomeric seal bushing 140 has an outer diameter 141 and is closely received in a groove 142 defined in first collet sleeve 88. Elastomeric seal bushing 140 has an inner surface 143 that slopes radially inwardly from an upper end 147 to a lower end 144 thereof. An outer surface 145 slopes radially inwardly from outer diameter 141 to lower end 144. The angle of slope is such that first seal bushing 140 will nest in collet heads 96. First seal bushing 140 extends upwardly from collet heads 96 to cover at least a portion of slots 93, and in the embodiment described extend beyond an upper end of slots 93 such that the entire length of each of slots 93 is covered. First seal bushing 140 prevents, or at least minimizes the amount of fluid, such as for example, but not limited to mud, that leaks through slots 93. When the slots are uncovered, there can be a pressure loss as a result of fluid passing through slots 93. The pressure loss makes it more difficult to generate the pressure needed to expand the collet fingers 94 outwardly with tripping ball 70. When the slots 93 are covered, the pressure needed to create the first breakaway force is more easily determined and achieved. The expansion of the collet fingers 94 causes plastic deformation. Thus, collet fingers 94 may be described as plastically deformable fingers.

A second annular space 146 having a diameter 148 is defined by outer housing 52 below first installation sleeve 130. Diameter 148 is greater than diameter 135 of first installation sleeve 130, and allows first breakaway seat 98 to expand radially outwardly to its second diameter 101.

In operation once casing 20 has been lowered to a desired location in the well cementing can begin. Fluid may be displaced ahead of the cement 30 and pressure increased so that tripping ball 70 will engage and pass through retaining ring 66. Tripping ball 70 will be displaced downwardly until it engages first breakaway seat 98. Pressure is applied thereabove until a sufficient force is reached to break first shear pin 138 to disengage first collet sleeve 88 from first valve housing 62. The force required to break the first shear pin 138 may be referred to as the first shearing force. First collet sleeve 88 will move to its second position 108, and first flapper 80 will move to closed position 106. After first collet sleeve 88 moves to second position 108, pressure is increased above tripping ball 70 until first breakaway seat 98 deforms and spreads radially outwardly into annular space 146 to allow tripping ball 70 to pass therethough. The force required to deform the first breakaway seat may be referred to as a first breakaway force. The first seal bushing 140 will prevent fluid from passing through slots 93 as pressure is applied to tripping ball 70 to deform first collet heads 96. The first shearing force in some cases is less than the first breakaway force, such that the pressure required in the casing to reach the first shearing force is less than that required to reach the first breakaway force. Both the first shearing force and first breakaway force and the pressure required to reach both may be predetermined. Downward movement of first collet sleeve 88 will be prevented by engagement with first installation sleeve 130. Upward movement of first collet sleeve 88 is prevented by tail section 137 of first installation sleeve 130. Because the collet fingers 94 are plastically deformed to the second diameter 101, upward movement of first collet sleeve 88 is prevented by tail section 137 of first installation sleeve 130. Collet fingers 94 are expanded radially outwardly to a diameter sufficient to prevent them from moving upwardly past tail section 137. Collet fingers 94 expand outwardly in annular channel 146. One-way flow in the downward direction through housing 52 and thus through float collar 40 is allowed, but upward flow is prevented. Cementing of casing string 20 can therefore be performed through flapper valve 58. In one embodiment more than one flapper valve may be utilized. The current disclosure includes a second flapper valve 60.

Flapper valve 60 is generally like flapper valve 58. Second flapper valve 60 comprises second flapper valve housing 162 which forms a part of outer housing 52. Second flapper valve housing 162 comprises an upper housing portion 182 and a lower housing portion 186. Second annular space 146 is defined by upper housing portion 182 of second flapper valve housing 162. A second flapper 180 is pivotally connected to upper housing portion 182 with a pivot pin 184 or other mechanism. Second flapper 180 is biased with a spring or otherwise to move from the open position 202 to the closed position 206 which is shown in FIG. 6.

Lower housing portion 186 of second flapper valve 60 is connected to upper housing portion 182. Second flapper 180 in the open position extends downwardly into lower housing portion 186 and is restrained in the open position by a second collet sleeve 188 that is detachably connected in housing 52 and more specifically in lower housing portion 186 of second flapper valve housing 162. Second collet sleeve 188 has outer surface 189, upper end 190 and lower end 192. Second collet sleeve 188 has a plurality of second collet fingers 194 with radially inward facing second collet heads 196 at the lower end 192 of second collet sleeve 188. Second collet heads 196 define a breakaway seat 198 which may be referred to as a second breakaway seat 198. Second breakaway seat 198 has a diameter 200 which is smaller than diameter 72 of tripping ball 70. Second breakaway seat 198 is expandable radially outwardly to a second diameter 201 which allows tripping ball 70 to pass therethrough. Second breakaway seat 198 expands upon the application of a force applied thereto as a result of pressure being increased above tripping ball 70. Second collet fingers 194 have spaces 193 therebetween. Spaces 193 extend from the lower end 192 of second collet sleeve 188 upwardly a distance 195, which in the embodiment described is a portion of the overall length from lower end 192 to upper end 190.

FIGS. 3-5 show the first position 204 of second collet sleeve 188 in which second collet sleeve 188 restrains second flapper 180 in its open position 202. In the open position 202 two-way flow is permitted through the second flapper valve housing 162. The closed position 206 of second flapper 180 is shown in FIG. 6. In the closed position 206 one-way flow only is allowed through second flapper valve 60. Thus, cement can flow downwardly therethrough but upward flow is prevented by second flapper valve 60 and specifically by second flapper 180 which is biased towards upper housing 182 in which the closed position 206 will engage a seat 183 defined on upper housing portion 182 to prevent upward flow therethrough. Second flapper 180 moves to the closed position 206 when second collet sleeve 188 is detached from second flapper valve housing 162 and moves downwardly to its second position 208.

Upper housing portion 182 of second flapper valve 60 has a bore 210 with a diameter 211 that is large enough to allow tripping ball 70 to pass therethrough. Housing 52 has a bore 212 and specifically lower housing portion 186 of second flapper valve housing 162 has a bore 212 that extends radially outwardly from bore 210. Bore 212 has a first portion 214 and a second portion 215 below first portion 214. Second portion 215 is a generally cylindrical portion. Second portion 215 has at least one groove 216 therein. A seal, which may be an O-ring seal 218 is disposed in groove 216. O-ring seal 218 sealingly engages second collet sleeve 188 on outer surface 189 thereof. Outer surface 189 of second collet sleeve 188 has a first outer diameter 222 with an outwardly extending shoulder 224 extending radially outward therefrom. Shoulder 224 defines a second outer diameter 226 that is greater than outer diameter 222. O-ring seal 218 in one embodiment engages second collet sleeve 188 at the outer diameter 226 on shoulder 224.

A third annular space 228 is defined by and between the lower housing portion 186 of second flapper valve housing 162 and second collet sleeve 188. Third annular space 228 is positioned below shoulder 224. A second installation sleeve 230 with upper end 232 and lower end 234 is positioned in annular space 228 and is threadedly connected to second flapper valve 162 on the lower housing portion 186 thereof. Second installation sleeve 230 has inner surface 231 that defines a first inner diameter 233 and a second inner diameter 235 that is larger than diameter 233. Second inner diameter 235 is defined on a tail portion 237 of second installation sleeve 230. Collet heads 196 are initially held in place by second installation sleeve 230, and more specifically by tail portion 237 to prevent the breakaway seat 198 from expanding radially outwardly prematurely. Thus, second installation sleeve 230 retains collet heads 196 in the first position of second collet sleeve 188. A second shear pin 238 detachably connects second collet sleeve 188 to second installation sleeve 230. Second shear pin 238 in one embodiment is configured to shear at a predetermined force. The predetermined force generally will occur when a predetermined pressure is reached in the casing string as a result of a tripping ball engaging collet heads 196 on second collet sleeve 188.

A second seal bushing 240 which may be an elastomeric second seal bushing 240 has an outer diameter 241 and is closely received in a groove 242 defined in second collet sleeve 188. Elastomeric second seal bushing 240 has an inner surface 243 that slopes radially inwardly from an upper end 247 to a lower end 244 thereof. An outer surface 245 slopes radially inwardly from outer diameter 241 to lower end 244. The angle of slope is such that second seal bushing 240 will nest in collet heads 196. Second seal bushing 240 extends upwardly from collet heads 196 to cover at least a portion of slots 193, and in the embodiment described extend beyond an upper end of slots 193 such that the entire length of each of slots 193 is covered. Second seal bushing 240 prevents, or at least minimizes the amount of fluid, such as cement, that leaks through slots 193. O-ring seal 218 acts as a debris barrier and prevents debris from entering the space below shoulder 224 and into annular space 228. When the slots are uncovered, there can be a pressure loss as a result of fluid passing through slots 193. The pressure loss makes it more difficult to generate the pressure needed to expand the collet fingers 194 outwardly with tripping ball 70. When the slots 193 are covered, the pressure needed to create the first breakaway force is more easily determined and achieved. The expansion of the collet fingers 194 causes plastic deformation. Thus, collet fingers 194 may be described as plastically deformable fingers.

Figure 7:
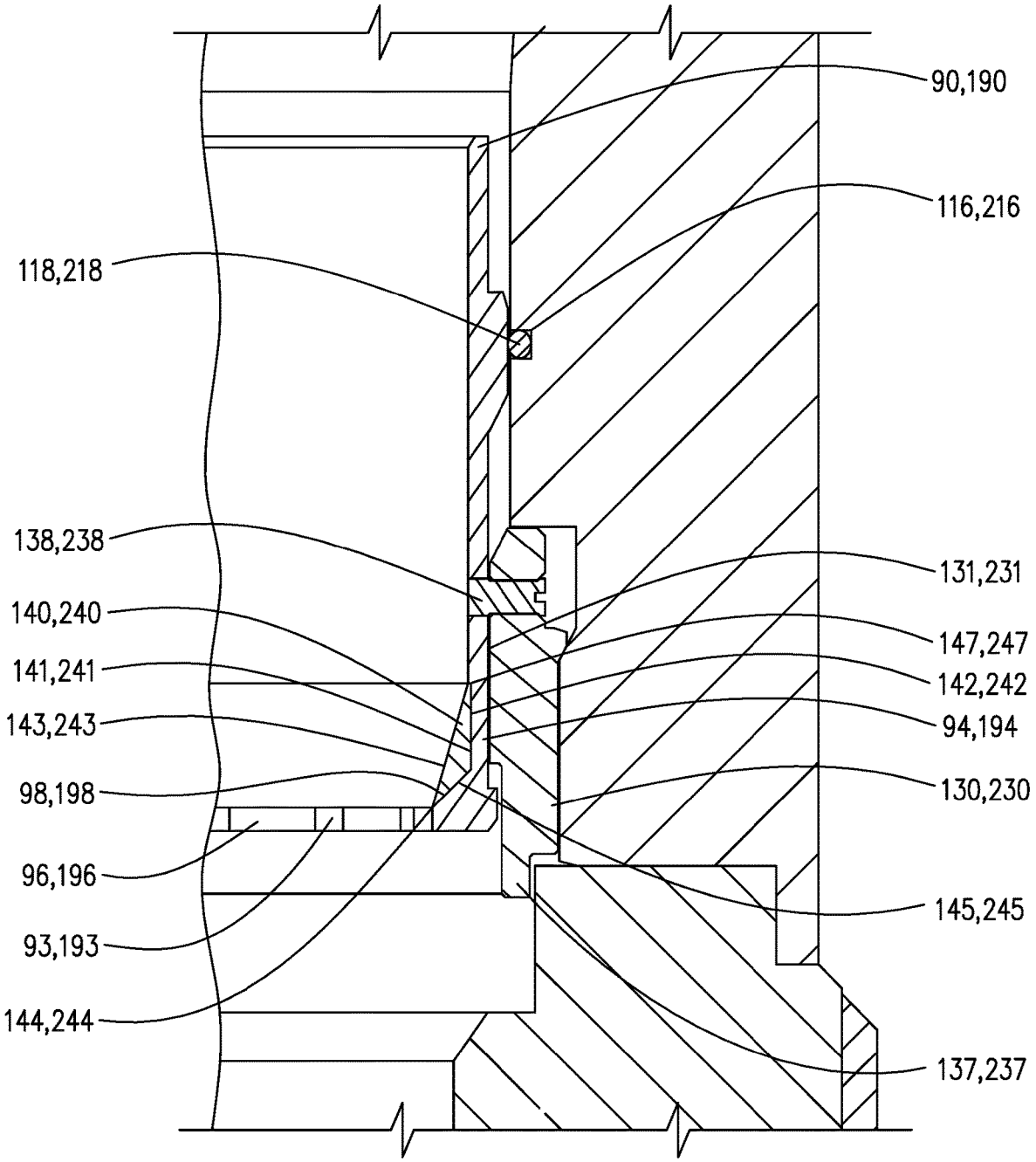
FIG. 7 is an enlarged cross section showing the arrangement of a collet sleeve with an installation sleeve and bushing.
Figure 8:
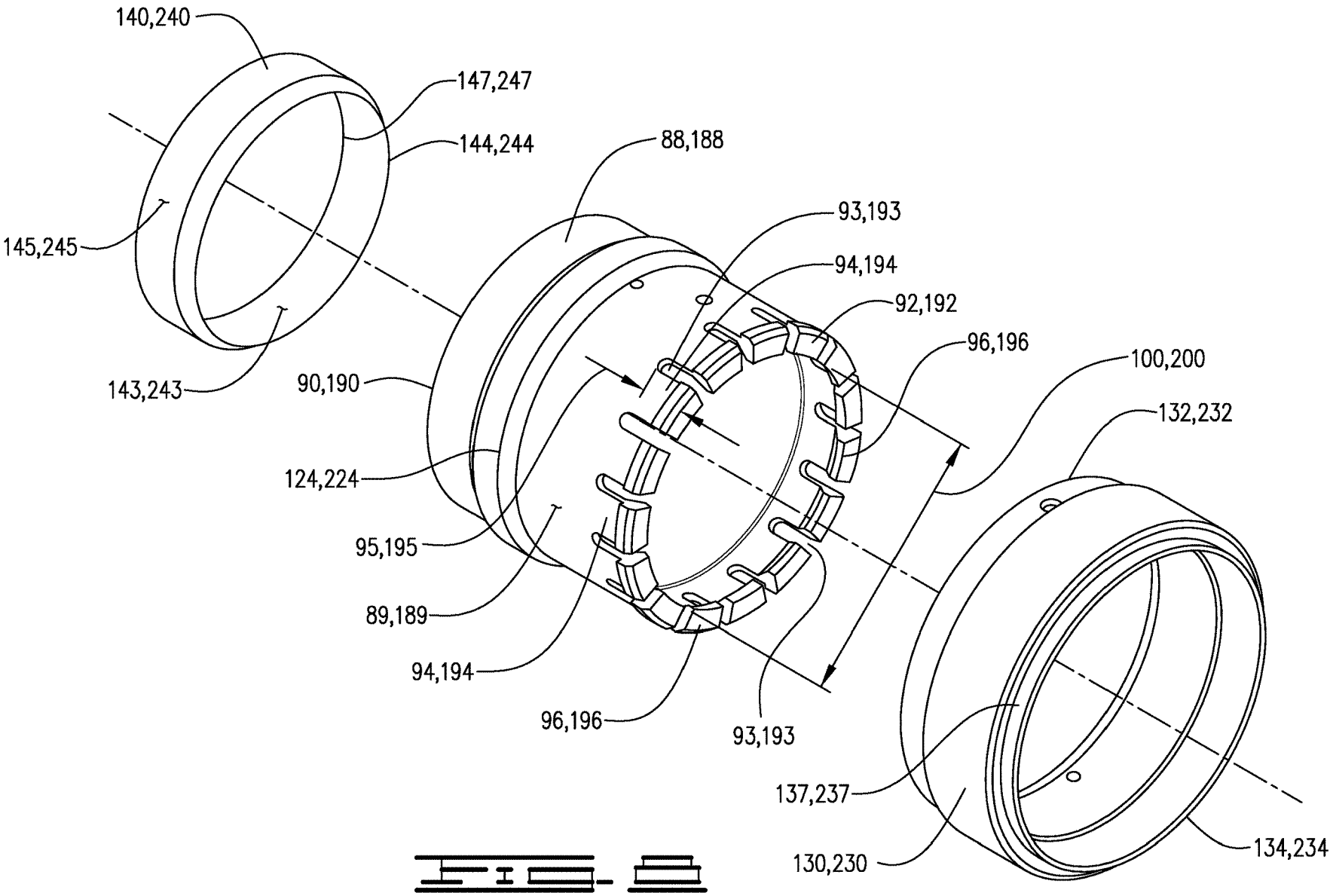
FIG. 8 is an exploded view of certain details of a fill valve assembly.

Because first and second collet sleeves 88 and 188, first and second installation sleeves 130 and 230 and first and second seal bushings 140 and 240 are generally identical, the numbers for the details of both are shown in FIGS. 7 and 8.

In operation once casing 20 has been lowered to a desired location in the well cementing can begin. Fluid may be displaced ahead of the cement 30 and pressure increased so that tripping ball 70 will engage and pass through retaining ring 66. As explained above, tripping ball 70 will be displaced downwardly until it engages first breakaway seat 98 and moves first collet sleeve 88 to its second position 108, which allows first flapper 80 to move to its closed position 106. Tripping ball 70 will then engage second breakaway seat 198 on second collet sleeve 188. Pressure is applied thereabove until a sufficient force is reached to break second shear pin 238 and disconnect second collet sleeve 188 from second valve housing 162. The force required to break the shear pin 238 may be referred to as the second shearing force. Second collet sleeve 188 will move downward to its second position 208, and second flapper 180 will move to closed position 206. After second collet sleeve 188 moves to second position 108, pressure is increased above tripping ball 70 until second breakaway seat 198 deforms and spreads radially outwardly allowing tripping ball 70 to pass therethough. Second breakaway seat 198 will expand radially outward once it passes lower end 234 of second installation sleeve 230. The force required to deform the second breakaway seat may be referred to as a second breakaway force. The first seal bushing 140 will prevent fluid from passing through slots 93 as pressure is applied to tripping ball 70 to deform first collet heads 96. The second shearing force is less than the second breakaway force, such that the pressure required in the casing to reach the second shearing force is in some cases less than that required to reach the second breakaway force. Both the second shearing force and second breakaway force and the pressure required to reach both may be predetermined. Downward movement of second collet sleeve 188 will be prevented by engagement with second installation sleeve 230. Because the collet fingers 194 are plastically deformed to the second diameter 226, upward movement of second collet sleeve 188 is prevented by tail section 237 of second installation sleeve 230. Collet fingers 194 are expanded radially outwardly to a diameter sufficient to prevent them from moving past tail section 237. One-way flow in the downward direction through housing 52 and thus through float collar 40 is allowed, but upward flow is prevented. Cementing of casing string 20 can therefore be performed through second flapper valve 60.

Embodiments disclosed herein include:

Embodiment 1: A valve assembly comprising a valve housing defining a flow passage therethrough and a first flapper moveable from an open position in the valve housing in which two-way flow is allowed to a closed position in which only one-way flow through the valve housing is permitted. A first collet sleeve is moveable from a first position to a second position in the valve housing, the first collet sleeve in the first position retaining the flapper valve in the open position. A first breakaway seat at a lower end of the first collet sleeve is expandable from a first diameter to a second larger diameter. A first installation sleeve is disposed in the valve housing between the valve housing and the first collet sleeve. A first shear pin detachably connects the first collet sleeve to the first installation sleeve and the first collet sleeve is detachable from the first installation sleeve upon the application of a first shearing force applied to the first breakaway seat.

Embodiment 2: The valve assembly of embodiment 1 further comprising a first seal bushing disposed in the first collet sleeve, the first collet sleeve having a plurality of slots extending upwardly from the lower end thereof, the first seal bushing covering at least a portion of a length of each of the slots.

Embodiment 3: The valve assembly of embodiments 1 or 2 further comprising a tripping ball releasably trapped in a cage above the first collet sleeve, the first collet sleeve moveable from the first to the second position upon the application of the first shearing force by the tripping ball.

Embodiment 4: The valve assembly of any of embodiments 1-3, the first breakaway seat expandable upon the application of a first breakaway force thereto applied by the tripping ball after the first collet sleeve has moved from the first to the second position.

Embodiment 5: The valve assembly of any of embodiments 1-4 further comprising a second flapper moveable from an open position in the valve housing in which two-way flow is allowed to a closed position in which only one-way flow through the valve housing is permitted, a second collet sleeve moveable from a first position to a second position in the housing, the second collet sleeve in the first position retaining the second flapper in the open position, a second breakaway seat at a lower end of the second collet sleeve, the second breakaway seat expandable from a first diameter to a second larger diameter, a second installation sleeve disposed in the valve housing between the valve housing and the second collet sleeve; and a second shear pin detachably connecting the second collet sleeve to the second installation sleeve, the second collet sleeve detachable from the second installation sleeve upon the application of a shearing force applied to the second breakaway seat.

Embodiment 6: The valve assembly of embodiment 5 further comprising a second seal bushing disposed in the second collet sleeve, the second collet sleeve having a plurality of slots extending upwardly from the lower end thereof, the second seal bushing covering at least a portion of a length of each of the slots.

Embodiment 7: A valve assembly comprising a casing, a valve housing connected in the casing, a first flapper pivotably connected in the housing, a first collet sleeve disposed in the valve housing in a first position, a first installation sleeve positioned between the valve housing and the first collet sleeve, the first collet sleeve detachably connected to the installation sleeve and moveable to a second position in the valve housing, the flapper moving from an open to a closed position when the first collet sleeve moves from the first to the second position in the valve housing.

Embodiment 8: The valve assembly of embodiment 7, further comprising a first shear pin detachably connecting the first collet sleeve to the first installation sleeve.

Embodiment 9: The valve assembly of either of embodiments 7 and 8, first collet sleeve moving from the first to the second position thereof upon the application of a first shearing force thereto.

Embodiment 10: The valve assembly of embodiment 9, the first collet sleeve defining a first breakaway seat expandable from a first diameter to a second diameter upon the application of a first breakaway force applied thereto.

Embodiment 11: The valve assembly of any of embodiments 7-10, further comprising a first seal bushing closely received in the first collet sleeve of a lower end thereof.

Embodiment 12: The valve assembly of embodiment 11, the first collet sleeve comprising a plurality of first collet fingers having spaces therebetween around the circumference of the first collet sleeve, the spaces extending upwardly from a bottom of the first collet sleeve at least a portion of the full length of the first collet sleeve, the first seal bushing positioned to cover at least a portion of the length of each of the spaces between the collet fingers.

Embodiment 13. The valve assembly of embodiment 12, the first seal bushing completely covering the spaces between the first collet fingers to prevent the flow of fluid therethrough.

Embodiment 14: The valve assembly of any of embodiments 7-13, the first collet sleeve having an outer surface defining a first diameter and a shoulder extending radially outwardly from the first diameter, the radially outwardly extending shoulder sealingly engaged with the valve housing in the first position of the first collet sleeve.

Embodiment 15: A valve assembly comprising a first flapper moveable from an open to a closed position in a valve housing, a first collet sleeve moveable from a first to a second position in the valve housing, the first collet sleeve in its first position retaining the first flapper in the open position, the first collet sleeve sealingly engaged with the valve housing in the first position of the first collet sleeve, a first installation sleeve disposed in the valve housing between the first collet sleeve and the valve housing and the first collet sleeve detachably connected to the first installation sleeve, the first collet sleeve defining a plastically deformable first breakaway seat sized to engage a tripping ball displaced into the first collet sleeve, the first breakaway seat having a first breakaway force greater than a first shearing force required to break the shear pin.

Embodiment 16: The valve assembly of embodiment 15 comprising a second flapper moveable from an open to a closed position in a valve housing; a second collet sleeve moveable from a first to a second position in the valve housing, the second collet sleeve in its first position retaining the second flapper in the open position, the second collet sleeve sealingly engaged with the valve housing in the first position of the second collet sleeve, a second installation sleeve disposed in the valve housing between the second collet sleeve and the valve housing, the second collet sleeve detachably connected to the second installation sleeve, the second collet sleeve defining a plastically deformable second breakaway seat sized to engage the tripping ball displaced into the second collet sleeve.

Embodiment 17: The valve assembly of either of embodiments 15-16, the first collet sleeve defining a plurality of spaced apart first collet fingers, the first collet fingers having a plurality of radially inwardly extending first collet heads at a lower end thereof, the collet heads defining the breakaway seat.

Embodiment 18: The valve assembly of any of embodiments 15-17, further comprising a first seal bushing disposed in the first collet sleeve at a lower end thereof and covering at least a portion of the spaces between the first collet fingers.

Embodiment 19: The valve assembly of embodiment 18, the first collet fingers having longitudinally extending spaces therebetween, the first seal bushing positioned to completely cover each of the longitudinally extending spaces.

Embodiment 20: The valve assembly of any of embodiments 15-19, the first being detachably connected with a shear pin to the first installation sleeve.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A valve assembly comprising:

a valve housing defining a flow passage therethrough;

a first flapper moveable from an open position in the valve housing in which two-way flow is allowed to a closed position in which only one-way flow through the valve housing is permitted;

a first collet sleeve moveable from a first position to a second position in the valve housing, the first collet sleeve in the first position retaining the first flapper valve in the open position;

a plurality of collet fingers defined at a lower end of the first collet sleeve, the collet fingers defining a plurality of slots therebetween extending upwardly from the lower end of the first collet sleeve;

a first deformable breakaway seat at the lower end of the first collet sleeve, the first breakaway seat being deformable radially outwardly from a first diameter to a second larger diameter;

a first installation sleeve disposed in the valve housing between the valve housing and the first collet sleeve, wherein the first installation sleeve prevents the first deformable breakaway seat from deforming from the first to the second larger diameter when the first collet sleeve is in the first position;

a first shear pin detachably connecting the first collet sleeve to the first installation sleeve, the first collet sleeve detachable from the first installation sleeve upon the application of a first shearing force applied to the first breakaway seat; and a first seal bushing having an inner surface and an outer surface, the first seal bushing being closely received in the first collet sleeve and positioned therein to cover at least a portion of a length of each of the slots between the collet fingers and to restrict flow therethrough from an interior of the first collet sleeve, wherein the outer surface of the first seal bushing engages an inner surface of the collet sleeve and is shaped to nest therein.

2. The valve assembly of claim 1 wherein the first seal bushing completely covers each of the slots between the collet fingers on the first collet sleeve.

3. The valve assembly of claim 2, further comprising:

a second flapper moveable from an open position in the valve housing in which two-way flow is allowed to a closed position in which only one-way flow through the valve housing is permitted;

a second collet sleeve moveable from a first position to a second position in the housing, the second collet sleeve in the first position retaining the second flapper in the open position;

a plurality of collet fingers defined at a lower end of the second collet sleeve, the collet fingers defining a plurality of slots therebetween extending upwardly from the lower end of the second collet sleeve;

a second deformable breakaway seat at a lower end of the second collet sleeve, the second breakaway seat being deformable radially outwardly from a first diameter to a second larger diameter;

a second installation sleeve disposed in the valve housing between the valve housing and the second collet sleeve; and a second shear pin detachably connecting the second collet sleeve to the second installation sleeve, the second collet sleeve detachable from the second installation sleeve upon the application of a shearing force applied to the second breakaway seat.

4. The valve assembly of claim 3 further comprising a second seal bushing closely received in the second collet sleeve and positioned therein to cover at least a portion of a length of each of the slots between the collet fingers on the second collet sleeve and to restrict flow therethrough from an interior of the second collet sleeve.

5. The valve assembly of claim 1 further comprising a tripping ball releasably trapped in a cage above the first collet sleeve, the first collet sleeve moveable from the first to the second position upon the application of the first shearing force by the tripping ball.

6. The valve assembly of claim 5, the first breakaway seat being plastically deformable radially outwardly upon the application of a first breakaway force applied thereto by the tripping ball after the first collet sleeve has moved from the first to the second position.

7. The valve assembly of claim 1, the inner surface of the collet sleeve having a groove defined therein, the first seal bushing being received in the groove.

8. A valve assembly comprising:

a casing;

a valve housing connected in the casing;

a first flapper pivotably connected in the housing;

a first collet sleeve disposed in the valve housing in a first position, the first collet sleeve comprising a plurality of first collet fingers having spaces therebetween around the circumference of the first collet sleeve, the spaces extending upwardly from a bottom of the first collet sleeve at least a portion of the full length of the first collet sleeve;

a first installation sleeve positioned between the valve housing and the first collet sleeve, the first collet sleeve detachably connected to the installation sleeve and moveable to a second position in the valve housing, the first flapper moving from an open to a closed position when the first collet sleeve moves from the first to the second position in the valve housing; and a first seal bushing closely received in an annular groove defined in an inner surface of the first collet sleeve at a lower end thereof, the annular groove extending only partially through a wall of the collet sleeve, the first seal bushing positioned to cover at least a portion of a length of each of the spaces between the collet fingers and to restrict flow therethrough from an interior of the first collet sleeve.

9. The valve of claim 8, further comprising a first shear pin detachably connecting the first collet sleeve to the first installation sleeve.

10. The valve assembly of claim 9, the first collet sleeve moving from the first to the second position thereof upon the application of a first shearing force thereto.

11. The valve assembly of claim 8, the first collet sleeve defining a first breakaway seat at the lower end thereof expandable from a first diameter to a second diameter upon the application of a first breakaway force applied thereto, wherein the installation sleeve prevents the first breakaway seat from expanding to the second diameter when the first collet sleeve is in the first position.

12. The valve assembly of claim 11, the breakaway seat comprising a plastically deformable breakaway seat that stays in the expanded position.

13. The valve assembly of claim 8, the first seal bushing completely covering the spaces between the first collet fingers to prevent the flow of fluid therethrough.

14. The valve assembly of claim 8, the first collet sleeve having an outer surface defining a first diameter and a shoulder extending radially outwardly from the first diameter, the radially outwardly extending shoulder engaged with the first installation sleeve in the first position of the first collet sleeve.

15. A valve assembly comprising:

a first flapper moveable from an open to a closed position in a valve housing;

a first collet sleeve moveable from a first to a second position in the valve housing, the first collet sleeve in its first position retaining the first flapper in the open position and sealingly engaged with the valve housing in the first position of the first collet sleeve;

a first installation sleeve disposed in the valve housing between the first collet sleeve and the valve housing;

a plurality of spaced apart first collet fingers with longitudinally extending spaces therebetween at a lower end of the collet sleeve, the collet sleeve having a plastically deformable first breakaway seat at the lower end thereof sized to engage a tripping ball displaced into the first collet sleeve, the first collet fingers having a plurality of radially inwardly extending first collet heads at a lower end thereof, the first collet heads defining the breakaway seat; and a first seal bushing having an outer surface and an inner surface, the outer surface of the first seal bushing being in engagement with an inner surface of the first collet sleeve at the lower end thereof wherein the first seal bushing nests in the first collet heads and covers at least a portion of the longitudinally extending spaces between the first collet fingers.

16. The valve assembly of claim 15 comprising:

a second flapper moveable from an open to a closed position in a valve housing;

a second collet sleeve moveable from a first to a second position in the valve housing, the second collet sleeve in its first position retaining the second flapper in the open position, the second collet sleeve sealingly engaged with the valve housing in the first position of the second collet sleeve;

a second installation sleeve disposed in the valve housing between the second collet sleeve and the valve housing; and the second collet sleeve detachably connected to the second installation sleeve, the second collet sleeve defining a plastically deformable second breakaway seat sized to engage a tripping ball displaced into the second collet sleeve.

17. The valve assembly of claim 15, the first seal bushing positioned to completely cover each of the longitudinally extending spaces between the first collet fingers.

18. The valve assembly of claim 15, the first collet sleeve being detachably connected to the first installation sleeve with a shear pin.

* * * * *